US005974712A

United States Patent [19]

Kallionpäa

[11] Patent Number: 5,974,712

[45] Date of Patent: Nov. 2, 1999

[54] TRAFFIC SIGN

[75] Inventor: Veijo Ensio Kallionpää, Rauma, Finland

[73] Assignee: Leo Laine Oy, Rauma, Finland

[21] Appl. No.: 08/860,161

[22] PCT Filed: Dec. 14, 1995

[86] PCT No.: PCT/FI95/00682

§ 371 Date: Aug. 21, 1997

§ 102(e) Date: Aug. 21, 1997

[87] PCT Pub. No.: WO96/19787

PCT Pub. Date: Jun. 27, 1996

[30] Foreign Application Priority Data

Dec. 19, 1994 [FI] Finland ..... 945961

[51] Int. Cl.[6] ..... G09F 15/00

[52] U.S. Cl. ..... 40/612; 40/607; 40/572

[58] Field of Search ..... 362/812; 40/606, 40/607, 612, 572, 608

[56] References Cited

U.S. PATENT DOCUMENTS

| | | | |
|---|---|---|---|
| 1,805,095 | 5/1931 | Horni | 40/607 |
| 1,843,630 | 2/1932 | Richmond | 40/572 |
| 1,886,004 | 11/1932 | Geyser | 40/608 |
| 2,562,553 | 7/1951 | Howenstine | 40/572 X |
| 2,614,207 | 10/1952 | Smith | 40/572 X |
| 2,622,357 | 12/1952 | Sprung | 40/607 |
| 2,791,851 | 5/1957 | Richter | 40/572 X |
| 2,798,939 | 7/1957 | White | 40/431 |
| 3,893,251 | 7/1975 | Coleman | 40/572 |
| 3,913,518 | 10/1975 | Kaplan | 40/612 X |
| 4,253,415 | 3/1981 | Ferch | 40/612 |
| 4,798,017 | 1/1989 | Giotis | 40/607 |
| 4,980,984 | 1/1991 | Kulp et al. | 40/610 |

FOREIGN PATENT DOCUMENTS

| | | |
|---|---|---|
| 0439304 | 7/1991 | European Pat. Off. . |
| 3310143 | 9/1994 | Germany . |
| 616975 | 4/1980 | Switzerland . |
| 2150175 | 6/1985 | United Kingdom . |

*Primary Examiner*—Brian K. Green
*Attorney, Agent, or Firm*—Ladas & Parry

[57] ABSTRACT

A traffic sign including a base member, a mounting post of an elastic weather-resistant material, a jacket, and a sign portion of elastic weather-resistant material displaying traffic indicia. The jacket has first and second halves provided with a space therebetween. Each of the halves has an outwardly curved outer surface integrally formed with a protective frame. The sign portion is disposed on the outwardly curved outer surface of at least the first of the halves. The protective frame has an edge having an elevation that extends outwardly beyond an outer periphery of the sign portion whereby to protect the outer periphery. Each of the outer surfaces is made of a pliable, elastic material.

8 Claims, 1 Drawing Sheet

TRAFFIC SIGN

FIELD OF THE INVENTION +ps Traffic sign

The present invention relates to a traffic sign serving as a traffic guide and providing road users with necessary information.

BACKGROUND OF INVENTION

Traffic signs have conventionally been manufactured of metal in such a way that the actual sign plate has been stamped from sheet metal onto which the required sign has been painted. In general, the mounting post of the traffic sign has been a metal tube or a metal profile bar. Traffic signs have been erected by the roadside or the side of the street either by sinking them into the ground or by employing various concrete base members or equivalent. In conventional traffic signs, the sign portion has been attached to the mounting post either integrally or by using lobes of different types, which has made it possible to replace a sign on a mounting post.

One disadvantage of conventional metal traffic signs has been their rigid construction, with the result that, in vehicle collisions with such signs, the damages have often been great. In traffic accidents, conventional traffic signs may cause damage not only to the vehicle but also to the driver and passengers. In accordance with studies on accidents that have been conducted in Finland, annually 20 persons die in crashes in which the damage has at least partially been caused by a traffic sign upon collision of a vehicle with the sign. For reasons of economy, metal traffic signs are normally made of a material susceptible to corrosion. When the paint layer covering the sign is damaged, corrosion can easily start spreading and may damage the entire sign. Salt used on roads has also accelerated corrosion of traffic signs and shortened the service life of conventional traffic signs, which is calculated to be about 5 to 10 years with metal signs. Moreover, from a ecological point of view, conventional metal traffic signs have not been recyclable.

SUMMARY OF INVENTION

The traffic sign in accordance with the present invention avoids the above drawbacks, and use of signs in accordance with the present invention is very economical. The traffic sign of the invention is defined in the appended claims.

In one embodiment, the traffic sign comprises a base member, a mounting post of an elastic weather-resistant material, a jacket, and a sign portion of elastic weather-resistant material displaying traffic indicia. The jacket comprises first and second halves provided with a space therebetween. Each of the halves comprises an outwardly curved outer surface integrally formed with a protective frame. The sign portion is disposed on the outwardly curved outer surface of at least the first of the halves. The protective frame comprises an edge having an elevation that extends outwardly beyond an outer periphery of the sign portion whereby to protect the outer periphery. Each of the outer surfaces comprises a pliable, elastic material.

One advantage of the traffic sign of the present invention is its long life. The sign can be estimated to have a service life as long as 50 years. The traffic sign of the invention has good resistance against loads and also acid and alkaline substances, and road salt will not cause problems to the sign. In order that the sign plate may be washed for example with a high-pressure washer or the like, it is embedded in a protective frame. Since the traffic sign is made of pliable plastic, it will not cause as much damage in a crash situation as metal traffic signs. The surfaces of the sign portion in accordance with the invention are curved, and due to of the elastic material of which they are made they yield to the slip stream of large vehicles or a scurry of snow spread by a snow-plough. Thus, snow adhering to the traffic sign will come off, and the sign can be read. Furthermore, the sign in accordance with the invention has been designed to be collapsible, and thus it can bend under a car in collision situations, and resultant damage is minimized. Since the traffic sign is hollow, it can be provided with a light source, and hence it is also perceptible in twilight and in the dark. Also, it is of advantage in wintertime if the sign is lighted, which will have the result, for instance, that snow will not adhere to the surface of the sign but will melt away. The mounting post of a sign in accordance with the present invention is suitable for use with fixing structures for conventional signs.

BRIEF DESCRIPTION OF THE DRAWINGS

In the following detailed description the invention will be described in greater detail with reference to the accompanying drawings in which.

DETAILED DESCRIPTION

Figure 1:
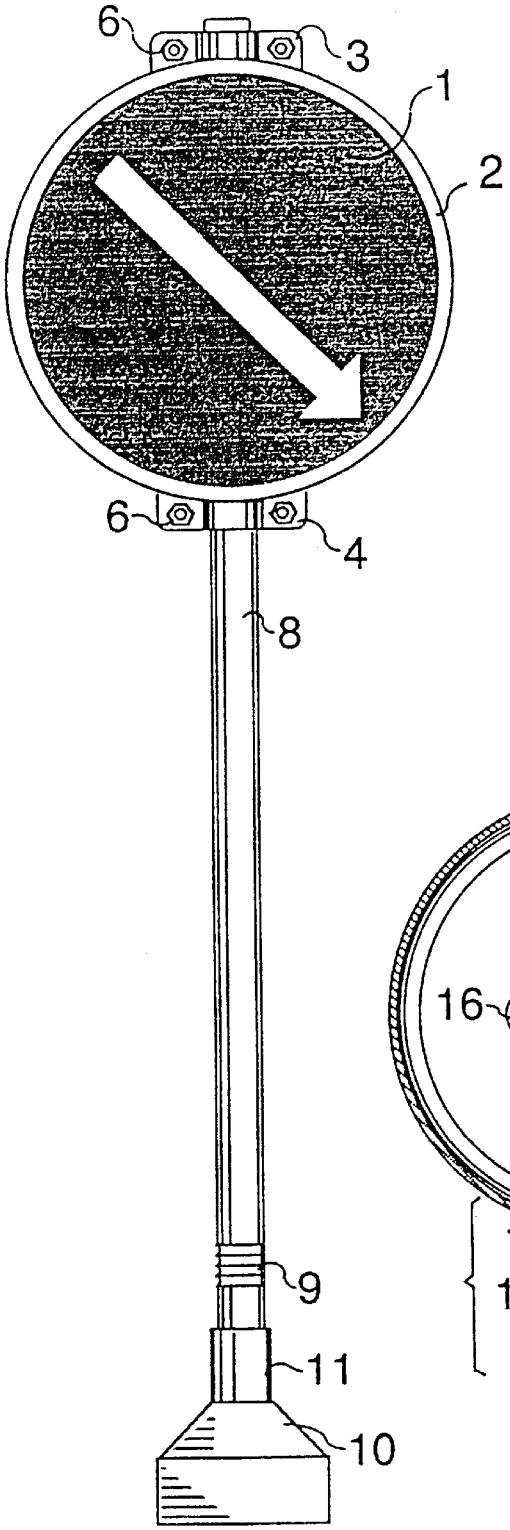
FIG. 1 is a front view of a traffic sign.
Figure 3:
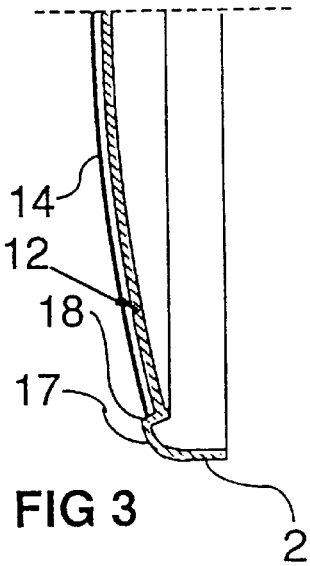
FIG. 3 illustrates the junction of a frame and a sign, portion of the traffic sign
Figure 4:
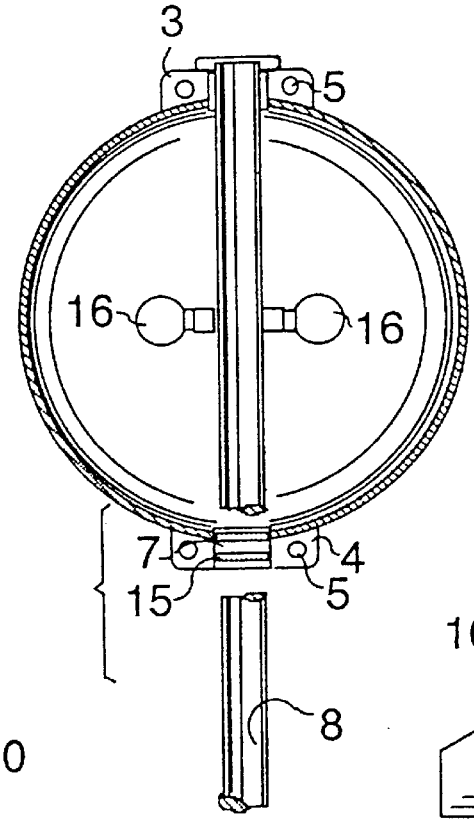
FIG. 4 shows an opened half of a top portion of the traffic sign.
Figure 2:
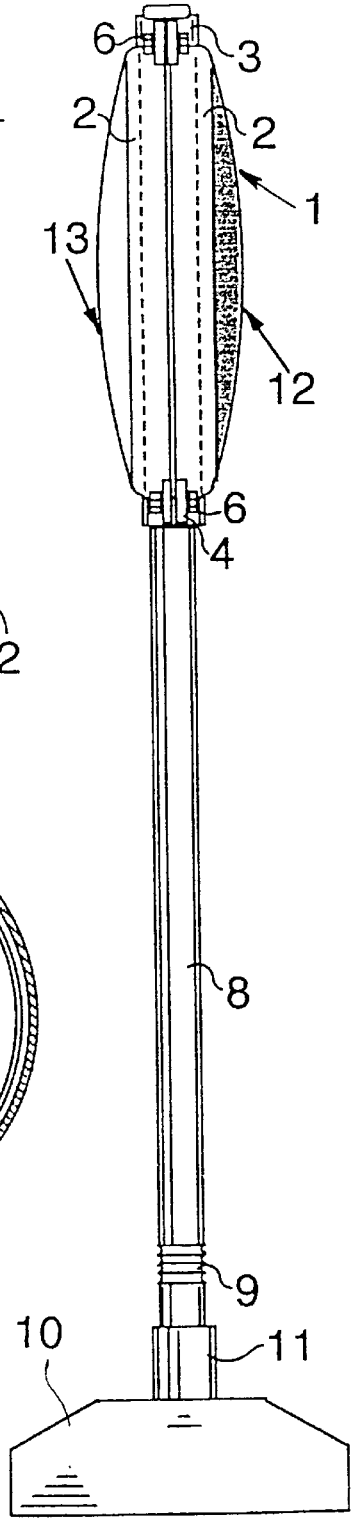
FIG. 2 is a side view of the traffic sign.

In FIGS. 1–3, reference 1 denotes generally a top portion and reference 2 a jacket of the top sign portion. Reference 3 denotes an upper fixing lug and reference 4 a lower fixing lug. Reference 5 denotes bolt apertures in the lugs 3 and 4. Reference 6 denotes fixing bolts and reference 7 a fixing aperture in a mounting post 8. Reference 9 denotes lightening grooves in the post and reference 10 a concrete base member having a socket 11 for mounting of the post 8. The outer surfaces of the top portion are denoted by references 12 and 13 and the actual display or sign portion by reference 14. Tapes 15 are provided as slide stops in the fixing aperture 7 of lug 4 in the post 8. Lamps providing a light source are denoted by reference 16. A frame protecting the sign portion 14 is denoted by reference 17 and an elevation by reference 18.

The traffic sign of the invention is used as a normal traffic sign, by erecting the sign by the roadside or the side of a street on a base member provided therefor, or otherwise securing the sign to its mounting location. As distinct from a conventional traffic sign, the sign of the invention can be placed at a more conspicuous site closer to the traffic lane, since it presents a smaller hazard in case of accident than conventional signs. Furthermore, in winter conditions snow can be removed from the traffic sign more efficiently when the sign is close to the traffic lane. The curved outer surfaces 12 and 13 made of an elastic material yield to air pressure and flow. Also at sites with a high traffic load, where easily perceptible traffic signs are required, a light source, a lamp 16, can be mounted within the sign, thus making the traffic sign self-luminous. Transparent HD polyethylene or an equivalent material is naturally used to manufacture such a traffic sign. If the lamp 16 produces enough heat, this gives the further advantage that the traffic sign can be easily perceived even during a heavy snowstorm, as snow will run off its surface. In a collision, either the mounting post 8 of the traffic sign will yield and the sign will flex at the lightening grooves 9, or the mounting post 8 will be broken, and thus the sign which is made of an elastic material will not cause any great damage to the vehicle. The top portion 1 of the traffic sign of the invention is made of two identical halves, the display or sign portion 14 being produced on the surface of one of the halves 12, 13 by serigraphy, painting, or equivalent methods. The halves are joined with plastic bolts through lugs 4 and 3. Slide stops 15 made of tape are provided on the inner surfaces of the lugs in the fixing apertures 7, and these prevent the top portion from rotating on the mounting post 8.

It is obvious that within the scope of the inventive idea, the traffic sign in accordance with the invention can be manufactured of a material other than the HD polyethylene disclosed in the present application. Also, as concerns the basic construction the parts of the traffic sign may be modified. Such parts include the fixing lugs, which are located on the outer peripheries of the sign portion, the upper lug constituting a cap on the upper end of the mounting post, thus preventing water from entering the post and the top portion.

I claim:

1. A traffic sign comprising a base member, a mounting post of an elastic weather-resistant material, a jacket, and a sign portion of elastic weather-resistant material displaying traffic indicia, said jacket comprising first and second halves with a space provided between portions of the first and second halves, each of said halves comprising an outwardly curved outer surface integrally formed with a protective frame, said sign portion being disposed on the outwardly curved outer surface of at least the first of the halves, said protective frame comprising an edge having an elevation that extends outwardly beyond an outer periphery of the sign portion whereby to protect the outer periphery, each of said outer surfaces comprising a pliable, elastic material, said traffic sign further comprising fastening means for joining the first and second halves, the post passing through and extending above the joined halves.

2. A traffic sign as claimed in claim 1 wherein the first and second halves are identical.

3. A traffic sign as claimed in claim 1, wherein the elastic material of each of said outer surfaces is sufficiently pliable to yield when subjected to a pressure wave caused by air flow a motor vehicle.

4. A traffic sign as claimed in claim 1 comprising a lamp in said space.

5. A traffic sign as claimed in claim 1 wherein the mounting post comprises lightening groove means for causing deflection of the post in a collision.

6. A traffic sign as claimed in claim 1, wherein the base member is concrete and the mounting post, jacket and sign portion are of recyclable materials.

7. A traffic sign as claimed in claim 1 wherein the fastening means comprises a plurality of lugs with apertures for receiving the mounting post and slide stop means for preventing the sign portion from rotating on the mounting post and from sliding downwards, said plurality of lugs comprising upper lugs enclosing an upper portion of the sign portion and the mounting post.

8. A traffic sign as claimed in claim 1 wherein the base member, the mounting post, the jacket and the sign portion are made of corrosion-free materials.

* * * * *